United States Patent [19]

Oka et al.

[11] Patent Number: 4,813,677

[45] Date of Patent: Mar. 21, 1989

[54] GOLF BALL

[75] Inventors: Kengo Oka, Nishinomiya; Kaname Yamada, Kakogawa, both of Japan

[73] Assignee: Sumitomo Rubber Industries, Ltd., Kobe, Japan

[21] Appl. No.: 858,214

[22] Filed: May 1, 1986

[30] Foreign Application Priority Data

Feb. 17, 1986 [JP] Japan ..... 61-33511

[51] Int. Cl.[4] ..... A63B 37/14

[52] U.S. Cl. ..... 273/232

[58] Field of Search ..... 273/232

[56] References Cited

U.S. PATENT DOCUMENTS

| | | | |
|---|---|---|---|
| 4,142,727 | 3/1979 | Shaw et al. | 273/232 |
| 4,560,168 | 12/1985 | Aoyama | 273/232 |

FOREIGN PATENT DOCUMENTS

| | | | |
|---|---|---|---|
| 49-52029 | 5/1974 | Japan | 273/232 |
| 53-115330 | 10/1978 | Japan | 273/232 |
| 57-107170 | 7/1982 | Japan | 273/232 |
| 60-96272 | 5/1985 | Japan | 273/232 |
| 60-163674 | 8/1985 | Japan | 273/232 |
| 1415413 | 11/1975 | United Kingdom | 273/232 |
| 2103939 | 3/1983 | United Kingdom | 273/232 |
| 2148132 | 5/1985 | United Kingdom | 273/232 |
| 2150840 | 7/1985 | United Kingdom | 273/232 |
| 2157959 | 11/1985 | United Kingdom | 273/232 |

*Primary Examiner*—George J. Mario

*Attorney, Agent, or Firm*—Birch, Stewart, Kolasch & Birch

[57] ABSTRACT

A golf ball having a plurality of different kinds of dimples formed on a spherical surface thereof is disclosed. In one embodiment, a plurality of four different kinds of dimples is formed on the spherical surface of the golf ball. The differences between the kinds of dimples can be a difference in diameter, in depth, or a combination of diameter and depth. The ratio of the product of the diameter and the depth of the largest dimple, to the product of the diameter and depth of the smallest dimple, is in the range of 1.5 to 2.0. Smooth portions are formed on the remainder of the spherical surface to such a size that a dimple having an area larger than an average area calculated from the respective areas of each kind of dimple constituting the plurality of different kinds cannot be formed. The total number of dimples ranges from 300 to 560, and there is a maximum of one great circle zone not traversing a part of any dimple.

19 Claims, 12 Drawing Sheets

GOLF BALL

BACKGROUND OF THE INVENTION

The present invention generally relates to a golf ball, and more particularly, to a golf ball provided with improved dimple construction.

Conventionally, with respect to the pattern or configuration of dimples on a golf ball, there have been many proposed and actual techniques mainly for the purpose of improving flight performance of the golf ball.

Such conventional techniques as referred to above may be broadly divided into one technique which intends to optimize individual shapes of uniform dimples (i.e., diameter, depth, cross sectional shape, etc. of the dimple) as disclosed, for example, in Japanese Laid-Open Patent Applications Tokkaisho Nos. 60-96272, 60-163674, 58-25180, 49-52029, etc., and the other technique which defines the interval or pitch between dimples within a predetermined range as disclosed, for example, in Japanese Patent Publication Tokkosho No. 58-50744 and Japanese Laid-Open Patent Application Tokkaisho No. 53-115330, another technique which proposes a mode for arranging all the dimples at an equal pitch as shown in Japanese Laid-Open Patent Application Tokkaisho No. 57-107170, etc., and still another technique in which portions without dimples are uniformly arranged on the spherical surface of the golf ball as disclosed in Japanese Patent Publication Tokkosho No. 57-22595.

What is common to these known techniques is that they are based on the assumption that the individual dimple dimensions are the same for all. Originally, since the golf ball is a spherical body which flies in a golf game at high speeds of 20 to 80 m/sec, and also through rotation at high speeds of 2,000 to 10,000 rpm, it has been conventionally thought that the concave and convex portions or undulation on the spherical surface of the golf ball affect the force of air flow as dimensions on the average.

Meanwhile, the role of dimples in a golf ball resides in one aspect that such dimples reduce the pressure resistance by accelerating transition of a turbulent flow at the boundary layer to cause a turbulent flow separation, thereby shifting the separating point backwards as compared with a laminar flow separation in a golf ball without having any dimples, so as to decrease the separating region for the consequent reduction of pressure resistance. In addition lift is increased between the upper and lower separating points. Moreover, such role must be effectively utilized all through the range from a low speed to a high speed.

However, when dimples of the same dimensions are arranged on the surface of a golf ball as in the prior are techniques referred to above, although the maximum effect is available at the flying speed in which the dimples of that shape act most effectively, such dimples do not effectively function at other flying speed regions, thus presenting certain problems in the overall performance of the ball.

On the other hand, with respect to the relation between the surface roughness of a spherical body and the resistance force as drag thereof, many studies have been made, and there is the trend that, as the surface roughness becomes large in comparison with the resistance force in a smooth ball, the resistance force at a critical Reynolds number is increased, with the result that a reduction in the critical Reynolds number is produced.

In the case of dimples for a golf ball, which is different from the roughness resulting from surface flaws, etc., the increase of the resistance force is small in the region exceeding the critical Reynolds number, but so far as the above trend is concerned, a similar tendency may also be noticed in the golf ball.

Meanwhile, the critical Reynolds number of a smooth ball is by far larger than that in the actual range of a golf ball, and is shifted towards a low speed region as the surface roughness is increased so as to be brought into the actual range of the golf ball.

Accordingly, in the golf balls, for example, if the dimple diameter is increased, the critical Reynolds number is lowered, and the resistance force in the low speed region is reduced, with an increasing trend of the resistance force in the high speed region. The trend similar to the above is also noticed when the number of dimples is increased or the depth of the dimples is increased to a certain extent. On the contrary, when the diameter and the number of the dimples are reduced or the depth of the dimples is decreased to a certain extent, the critical Reynolds number is raised, with the tendency that the resistance force in the low speed region is increased, while that in the high speed region is decreased.

Accordingly, in the available prior art no dimples which may display the maximum effects within the whole region ranging from the high speed period immediately after hitting up to peak flight, and also from peak flight to the low speed period leading to falling, thus presenting a limit to the improvement, although various studies were made into the dimple arrangement, etc. In other words, when the number or the diameter of the dimples is small, although the golf ball is allowed to fly favorably, extending over a long distance immediately after hitting, it is subjected to a so-called "hop" phenomenon which rises in the vicinity of the flight peak so as to fall at an obtuse angle, thus resulting in a loss in the flying distance at the latter half of the flight. In the case contrary to the above, the golf ball flies extending over a long distance to fall at a relatively acute angle, without the "hop" in the vicinity of flight peak, but it does not fly over a sufficient distance immediately after the flight, resulting in a loss of flying distance at the first half of the flight.

Meanwhile, together with the circumstances related to the resistance force as described above, there is a problem related to lift. More specifically, at the high speed region above a transition region, when the number or the diameter of dimples is large, or the dimple is deep to a certain extent, it is advantageous because of less influence by the wind, although disadvantageous from the aspect of the flight distance due to a small lift on the whole.

On the other hand, when the dimple arranging pattern itself is brought into question, there is a necessity for making the pattern non-directional as far as practicable, and various proposals have been made up to the present, some of which are as stated hereinbelow.

A first example which includes about 336 dimples arranged on a regular octahedron, or which includes 416 dimples as disclosed in Japanese Laid-Open Patent Application Tokkaisho No. 60-111665, a second example which includes 360 dimples arranged on a regular dodecahedron as disclosed in Japanese Patent Publication Tokkosho No. 57-22595, a third example which has 252 dimples, 432 dimples or 492 dimples arranged on an icosahedron as disclosed in Japanese Laid-Open Patent Application Tokkaisho No. 49-52029 or No. 60-234674, a fourth example which includes about 332 dimples by omitting one row or about 392 dimples by increasing one row at a seam portion of an icosahedron arrangement as disclosed in Japanese Patent Publication Tokkosho No. 58-50744, a fifth example which includes approximately 280 to 350 dimples arranged in concentric circles as disclosed in Japanese Laid-Open Patent Application Tokkaisho No. 53-115330, and a sixth example having 320 dimples disposed through an equal interval or pitch in a regular icosahedron arrangement as disclosed in Japanese Laid-Open Patent Application Tokkaisho No. 57-107170, etc.

In the above known examples, the fourth or fifth arranging pattern has a strong directivity in the arrangement of the dimples, and shows a difference in a trajectory of the golf ball according to a rotating axis upon hitting of the golf ball, thus being out of question from the viewpoint of the directivity elimination. Meanwhile, other arranging patterns may be considered favorable in the sense of non-directivity.

SUMMARY OF THE INVENTION

Accordingly, an essential object of the present invention is to provide an improved golf ball which is capable of minimizing the resistance force or drag, while simultaneously optimizing the lift, over the range for actual use of the golf ball from the high speed region to the low speed region, with substantial elimination of disadvantages inherent in the conventional golf balls.

In accomplishing these and other objects, according to one preferred embodiment of the present invention, there is provided a golf ball which includes a golf ball main body, a plurality of kinds of dimples formed on a spherical surface of the golf ball main body, and land portions defined on the spherical surface as surrounded by the dimples, with each of the land portions being formed into a size in which a fresh dimple having an area larger than an average area of the plurality of kinds of dimples, cannot be formed.

By the arrangement according to the present invention as described above, instead of disposing dimples of uniform configuration all over the golf ball, a plurality of kinds of dimples are arranged thereon. This arrangement is different from the state in which dimples are systematically aligned in any of the rotating axes on the golf ball spherical surface, air stream is disturbed still further, with a consequent retreatment of the separating point backwards, while, in the respective speed regions during the flight of the golf ball, the dimples having the respective configurations act effectively. More specifically, at the high speed region, the dimples with a small dimple effect display the desirable effect, whereas at the low speed region, the dimples having a large dimple effect display the expected effect. It is to be noted here that the "large dimple effect" means that a volume per each dimple is large, which may be achieved by increasing the dimple diameter or dimple depth, or by sharpening inclination of the dimple wall surface, or by the combination thereof. Meanwhile, the "small dimple effect" means that a volume per each dimple is small.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
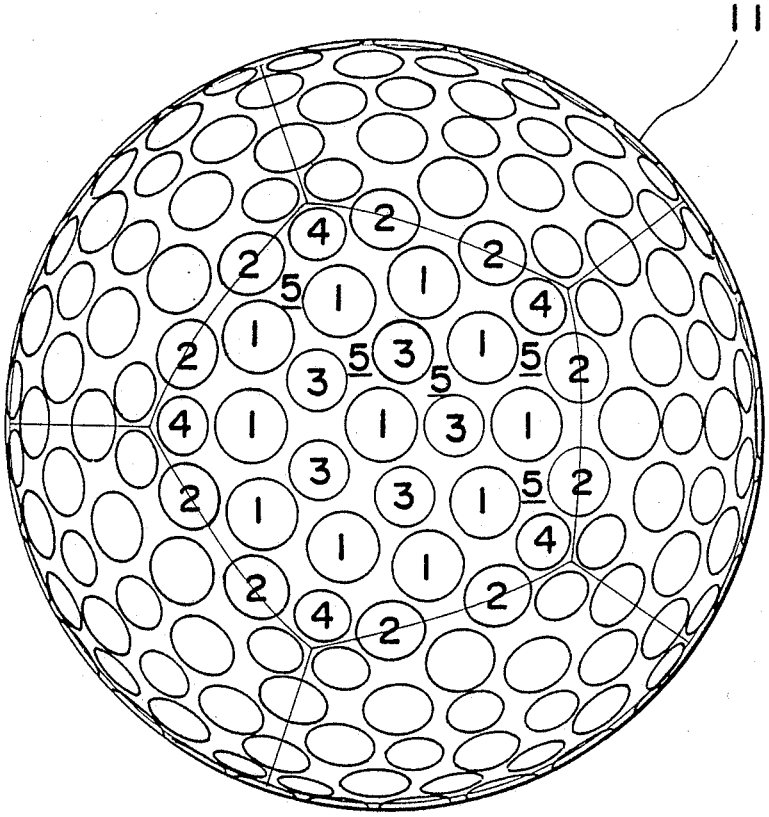
FIGS. 1, 2, 3, 4, 5, 6 and 7 are top plan views of golf balls showing dimple arranging patterns according to different embodiments of the present invention.

Before the description of the present invention proceeds, it is to be noted that like parts are designated by like reference numerals throughout the accompanying drawings.

Referring now to the drawings, there are specifically shown in FIGS. 1 through 7 golf balls having dimple arranging patterns according to different embodiments of the present invention.

In any of these embodiments, four kinds of large and small dimples 1, 2, 3 and 4 are arranged on the spherical surface of the golf ball, while land portions 5 defined on the spherical surface as surrounded by the dimples are each formed into a size in which a new dimple having an area larger than an average area of said dimples 1, 2, 3 and 4 cannot be formed. In other words, this means that, in each of such land portions 5, a circle having an area larger than the average area of the dimples and circumscribing the respective dimples 1, 2, 3 and 4 cannot be drawn.

Meanwhile, although the kinds of the dimples may of course be increased or decreased in number as desired, when the trajectory of the golf ball is taken into consideration, it is most preferable to divide a flight curve of the golf ball into four regions, thereby to combine four kinds of dimples having different dimple effects to correspond to the respective regions. By way of example, when a golf ball is hit under conditions of 65 m/sec for a ball flying speed, with "back spin" of 3500 rpm, the flight curve of the golf ball is divided into an initial trajectory in which the golf ball speeds are in the range of about 65 m/sec to 50 m/sec, a second trajectory in which the golf ball speeds are in the range of about 50 m/sec to 35 m/sec, a third trajectory in which the golf ball speeds are in the range of about 35 m/sec to 25 m/sec and which includes the highest point of the trajectory, and a fourth trajectory up to landing in which the golf ball speed is approximately 25 m/sec or thereabouts. In the above case, the flying time for the initial trajectory or the second trajectory is about one second, and that for the third trajectory or the fourth trajectory is about two seconds respectively, thus allowing the golf ball to stay in the air for about six seconds or so. For the dividing, although various practices may be considered, it should be designed as follows in order to display the maximum dimple effect.

More specifically, in the above example, on the assumption that the flying speeds V1, V2, V3 and V4 at the four regions are 65 m/sec, 50 m/sec, 35 m/sec and 25 m/sec, and the volumes of the four kinds of dimples from which the desirable effects are to be derived at the respective regions are represented by v1, v2, v3 and v4, it is preferable to design as in a relation $V1:V2:V3:V4=v4^2:v3^2:v2^2:v1^2=65:50:35:25$. In this case, although the value of v4/v1 becomes about 1.6, favorable results can be obtained in the range of 1.5 to 2.0. In other words, with respect to the dimple effect, the best result may be obtained when the flying speed desired to derive the effect therefrom is balanced with the square of the volume of the dimple.

Concerning the ratios for arranging the dimples having different dimple effects, it is preferable to raise the ratio of the dimples whose effect should be displayed at an emphasized region, depending on which of the divided regions such emphasized region is to be provided, and also to set the number of dimples for the minimum number of dimples, above 10% of the total number of the dimples. For example, when the numbers of the respective four kinds of dimples are represented by N1, N2, N3 and N4, with the greatest importance being attached to the third trajectory, and the next importance to the fourth trajectory, it is preferable to arrange as in a relation N1:N2:N3:N4$\approx$1:1:3:2. When the most importance is attached to the fourth trajectory, the preferable arrangement is N1:N2:N3:N4$\approx$1:1:1:2. Moreover, for the determination of such arranging ratios, the relation with respect to the total number of dimples should be taken into account, with more importance attached to the fourth and third trajectories as the total number of the dimples is decreased. By way of example, it is preferable to set the relation N1:N2:N3:N4, to approximately 1:1:1:2 for the total dimple number of 300 to 350, to approximately 1:1:2:2 for the total dimple number of 351 to 400, to about 1:1:3:2 for the total dimple number of 401 to 450, and to about 1:2:4:1 for the total dimple number of 451 to 500.

Figure 11:
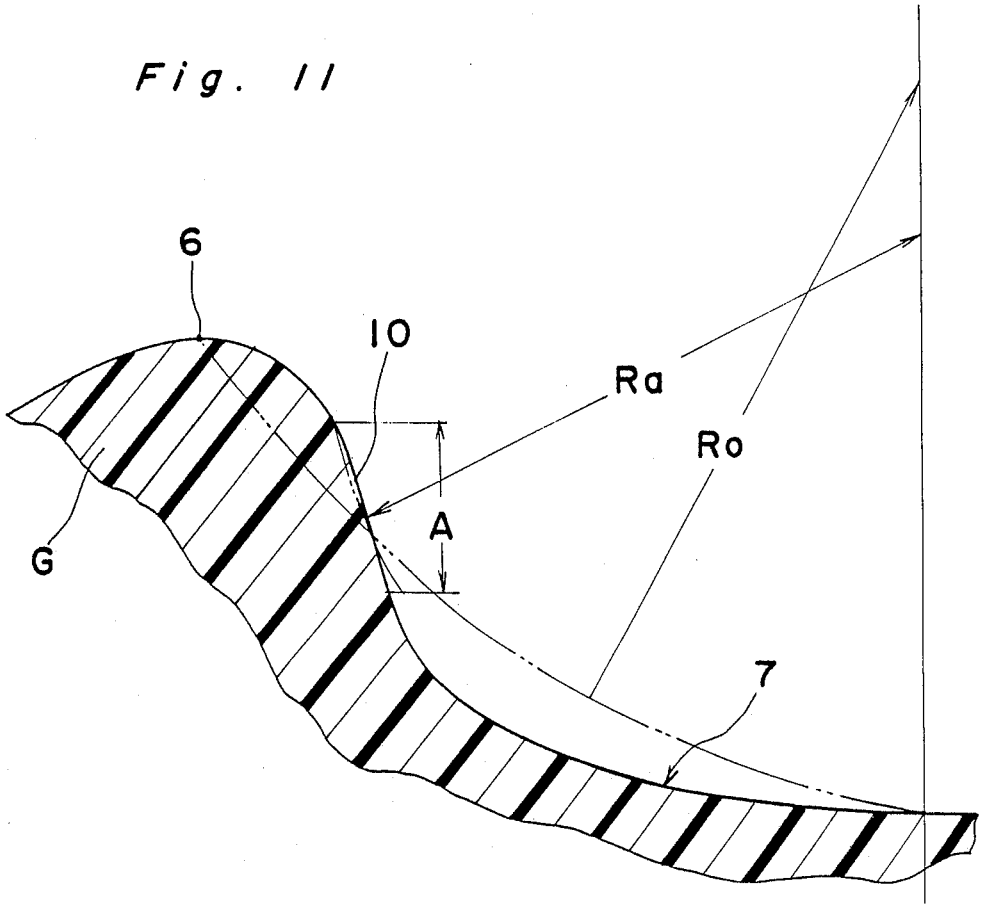
FIG. 11 is a fragmentary cross section of a golf ball for explaining a dimple effect.
Figure 12:
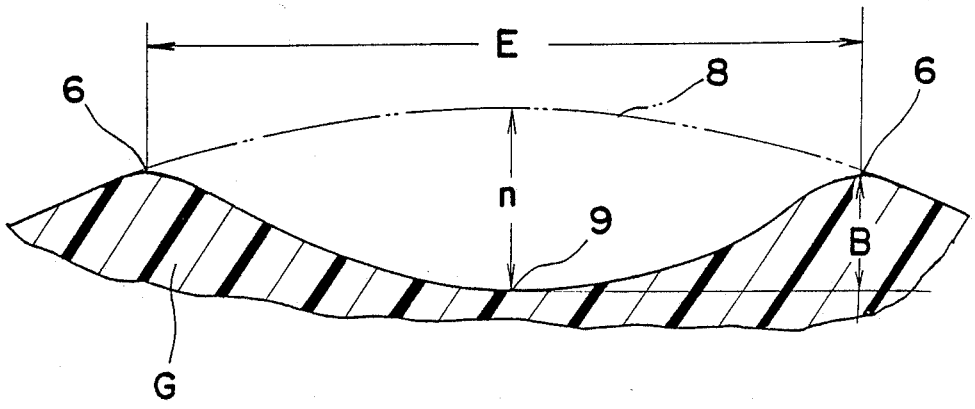
FIG. 12 is also a fragmentary cross sectional diagram of the golf ball.
Figure 13:
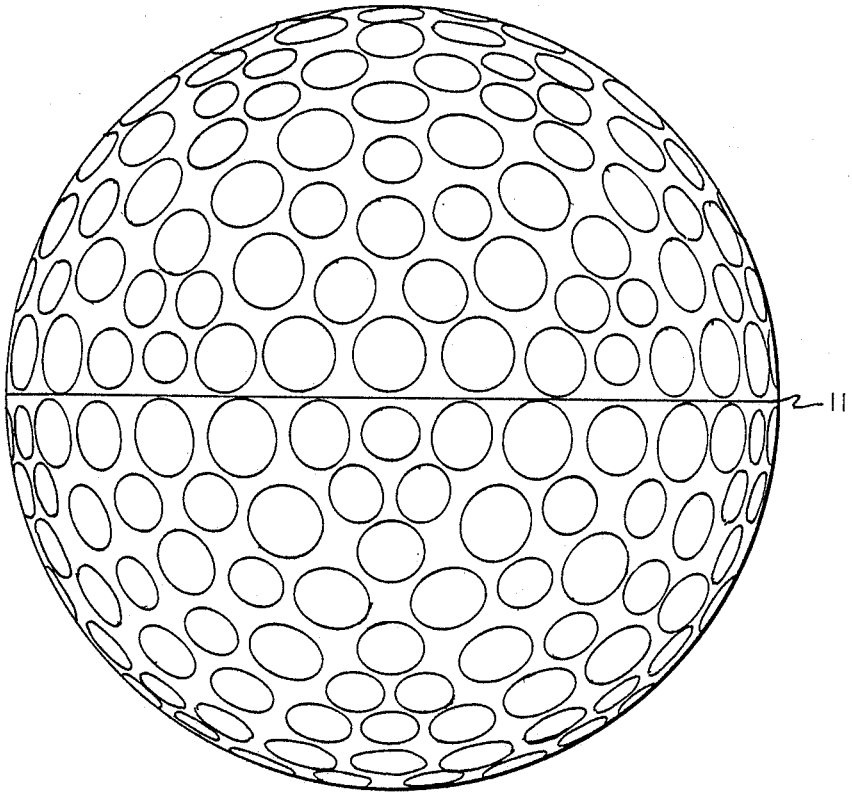
FIG. 13 illustrates a side view of a golf ball.

Accordingly, in the case of the spherical shape different dimples, with respect to the relation among the volume, diameter and depth, the volume is proportional to the product of the square of diameter and depth, but for the further improvement of the dimple effect, it may be so arranged as shown in FIG. 11 that an apparent radius Ra of a dimple spherical face 7 of a golf ball G in a range A between one point descended from the dimple edge 6 by 30 microns and another point descended therefrom by 90 microns in a direction of depth of the dimple is adapted to be 70 to 90% of the radius Ro of the dimple spherical face derived from the diameter E and depth n of said dimple (wherein the diameter E of the dimple means the distance between the dimple edges 6, and the depth n thereof is the distance from an imaginary spherical surface 8 of the golf ball G to the lowest point 9 of the dimple as shown in FIG. 12) so as to sharpen the inclination of the dimple wall surface 10 for rendering the dimple volume to be proportional to the product of the diameter E and the depth n, thereby to obtain a still more stable performance. Meanwhile, in the above case, if the product of the diameter E and the depth n is represented by C (i.e. by C1, C2, C3 and C4 in the respective dimples 1, 2, 3 and 4), the above relation v4/v1 may be approximated by C4/C1. In other words, the favorable range of the values for C4/C1 (the ratio of the product of the diameter E and the depth n) becomes 1.5 to 2.0. Furthermore, it is preferable to arrange that the depth n of the dimple is increased with the increase of the diameter E of the dimple, and that the ratio of the diameter E and the ratio of the depth n of the dimples are 1.2 to 1.5 respectively.

Finally, with respect to the dimple arrangement, in addition to the non-directional disposition, it is necessary for the stabilization of the separating point, to reduce as far as possible, a great circle zone 11 not containing even a part of each dimple over the entire spherical surface (such great circle zone represents an outer peripheral face of a cut face, when a sphere is cut so as to contain a center thereof). Therefore, in principle, the great circle zone becomes zero, but in each of the arrangements of FIGS. 1 to 4, FIG. 6, FIG. 7, and FIG. 13 one great circle zone 11 is formed as illustrated for the purpose of facilitation of mold-splitting during formation of golf balls. In the embodiment of FIG. 5, however, six great circle zones 11 are formed. It is to be noted here that in the present invention, the dimple number should be preferably in the range of 240 to 560.

Meanwhile, in any of the embodiments of FIGS. 1 through 7, it is preferable that a total dimple volume defined by a following formula is within a range of 250 $mm^3$ to 400 $mm^3$:

$$V = \sum_{i=1}^{\rho} V_i N = \sum_{i=1}^{\rho} N_i$$

$$V_i = \frac{0.001}{12} N_i \pi \left\{ \sum_{k=1}^{n-1} (E_{ik-1} \times E_{ik}) + 2 \times \Sigma E_{ik}^2 \right\}$$

where

V=total dimples volume ($mm^3$), $V_i$=total dimples volume ($mm^3$) of ith dimples, N=total number of dimples, $N_i$=number of ith dimples, R=diameter of the golf ball (mm), E=diameter of the dimple at a point descended in a direction of depth by K microns from the dimple edge (mm), and n=depth of dimple (microns).

Subsequently, experiments were carried out on the embodiments according to the present invention in order to study the effects thereof.

More specifically, through employment of a swing machine manufactured by True Temper Co., U.S.A., flight tests were conducted following the test procedures for ODS (Overall Distance Standard) of USGA (United States Golf Association) by the use of a No. 1 wood club, at the head speed of 45 m/sec, for evaluation of the results by the difference in flight carries or flying distances and total distances. (The above conditions generally meet the requirement for the golf ball initial speed of 65 m/sec.). The measurements were evaluated on an average value of 20 pieces of balls for each kind. Tabulated in Table 1 below are the kinds of balls employed for the respective experiments, and the results thereof in the form of a list.

TABLE 1

Figure 2:
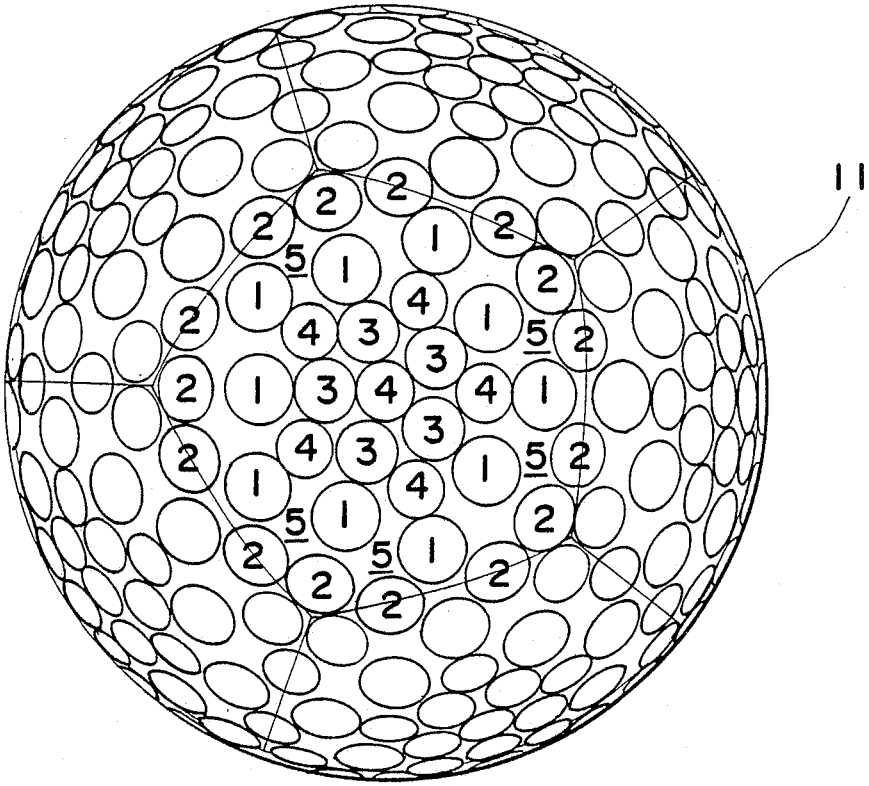
Figure 3:
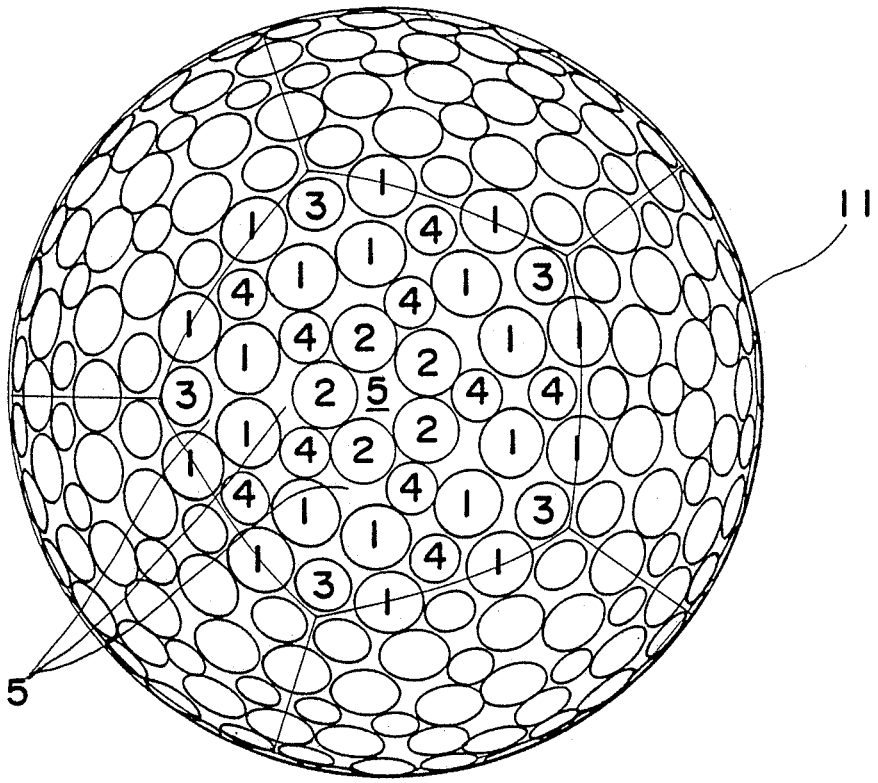
Figure 4:
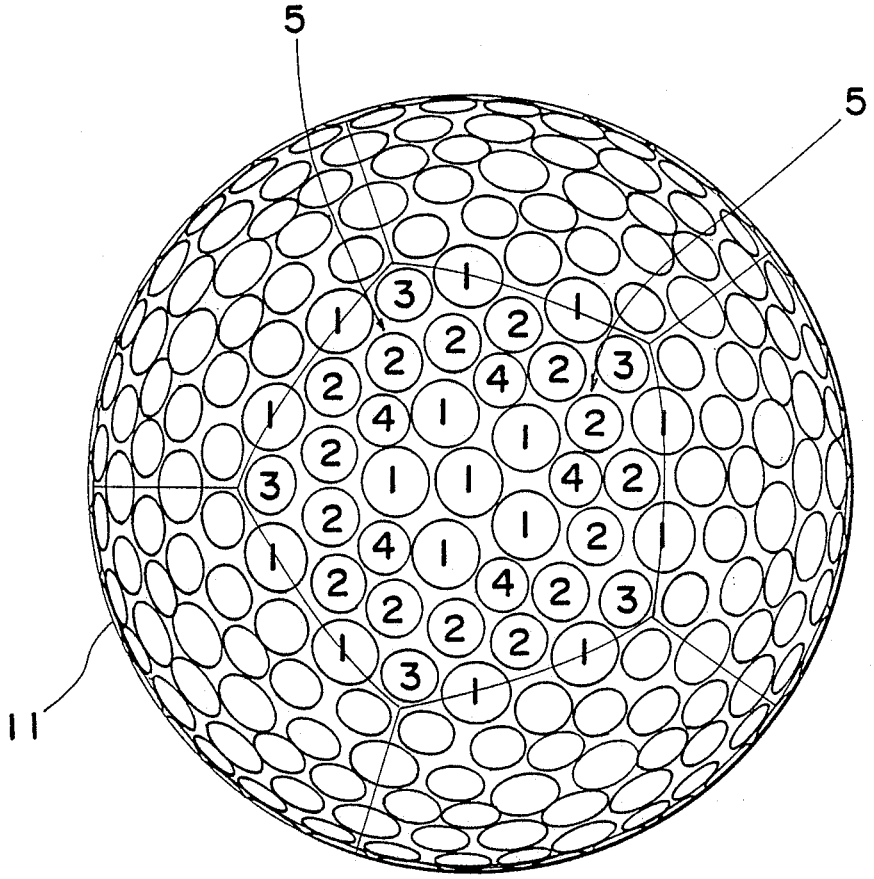
Figure 5:
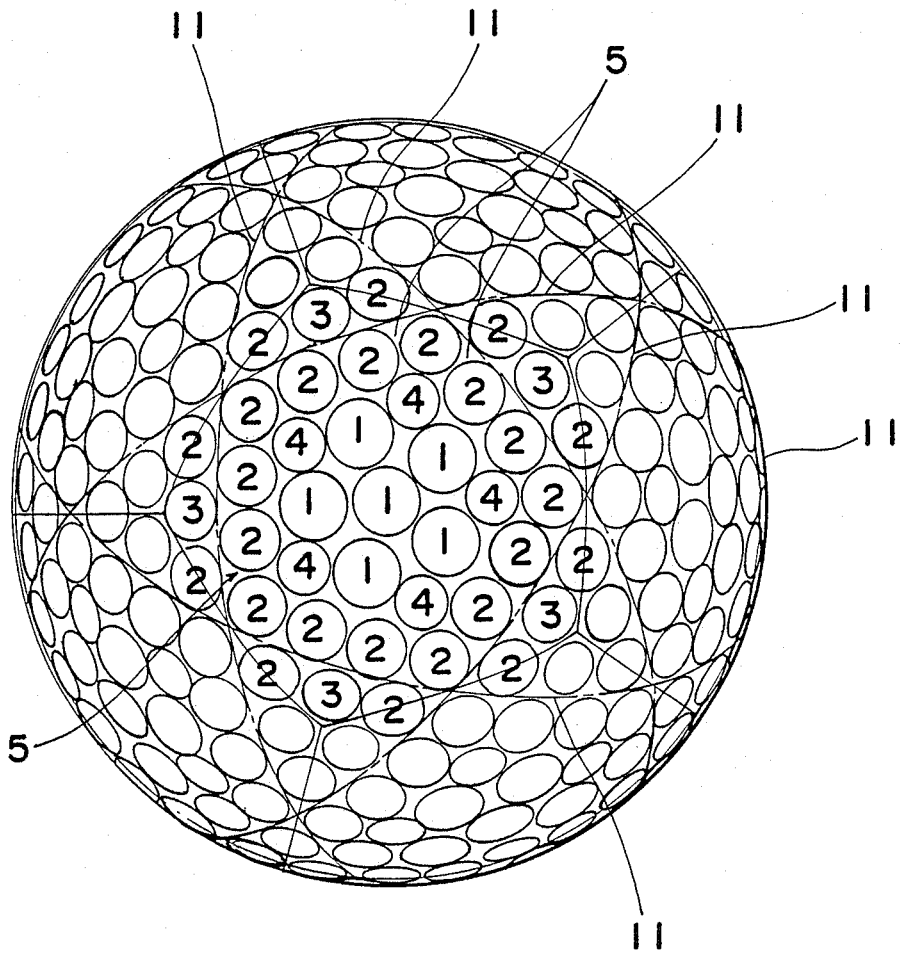
Figure 6:
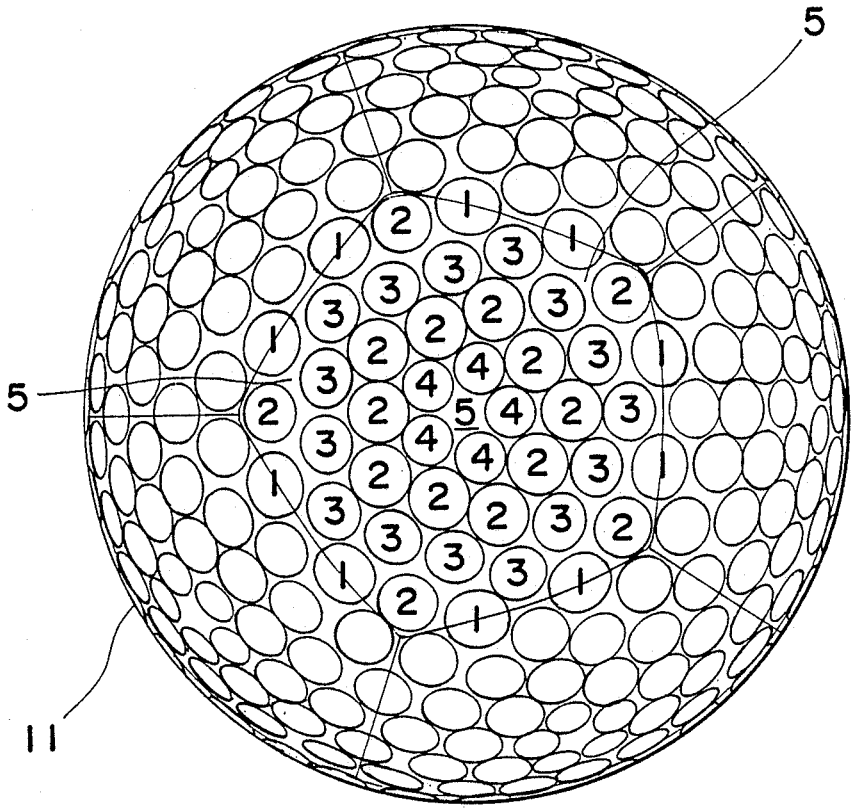
Figure 7:
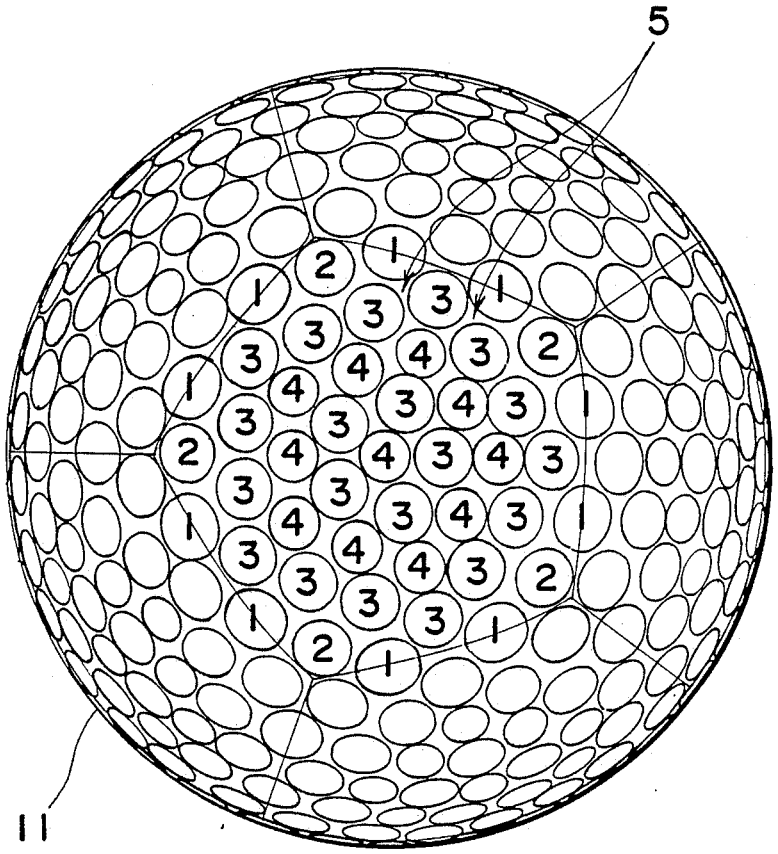

| Corresponding figure<br>Total No. of dimples | | Embod. 1<br>FIG. 1<br>312 | Embod. 2<br>FIG. 2<br>372 | Embod. 3<br>FIG. 3<br>420 | Embod. 4<br>FIG. 4<br>432 | Embod. 5<br>FIG. 5<br>432 | Embod. 6<br>FIG. 6<br>480 | Embod. 7<br>FIG. 7<br>492 |
|---|---|---|---|---|---|---|---|---|
| Dimple | | | | | | | | |
| Dia.-Depth-No. | No. 1 | 4.3-0.27-132 | 4.1-0.25-120 | 4.0-0.24-180 | 4.0-0.23-132 | 3.9-0.23-72 | 3.8-0.22-60 | 3.8-0.23-60 |
| (mm) (mm) | large | (0.16) | (0.15) | (0.15) | (0.14) | (0.14) | (0.14) | (0.14) |
| (Frontage | No. 2 | 3.9-0.25-60 | 3.8-0.23-120 | 3.8-0.23-60 | 3.5-0.21-180 | 3.6-0.22-240 | 3.6-0.21-180 | 3.6-0.22-60 |
| depth) | large | (0.16) | (0.15) | (0.14) | (0.14) | (0.14) | (0.14) | (0.14) |

TABLE 1-continued

| | | Embod. 1 | Embod. 2 | Embod. 3 | Embod. 4 | Embod. 5 | Embod. 6 | Embod. 7 |
|---|---|---|---|---|---|---|---|---|
| Corresponding figure | | FIG. 1 | FIG. 2 | FIG. 3 | FIG. 4 | FIG. 5 | FIG. 6 | FIG. 7 |
| Total No. of dimples | | 312 | 372 | 420 | 432 | 432 | 480 | 492 |
| | No. 3 | 3.6-0.23-60 | 3.6-0.23-60 | 3.3-0.20-60 | 3.3-0.20-60 | 3.3-0.21-60 | 3.4-0.20-180 | 3.4-0.21-240 |
| | large | (0.15) | (0.15) | (0.14) | (0.14) | (0.13) | (0.13) | (0.13) |
| | No. 4 | 3.3-0.21-60 | 3.2-0.20-72 | 3.0-0.19-120 | 3.1-0.19-60 | 3.1-0.19-60 | 2.9-0.18-60 | 2.9-0.18-132 |
| | large | (0.14) | (0.14) | (0.13) | (0.13) | (0.13) | (0.13) | (0.13) |
| Cmax/Cmin | | 1.7 | 1.6 | 1.7 | 1.6 | 1.5 | 1.6 | 1.7 |
| Emax/Emin | | 1.3 | 1.3 | 1.3 | 1.3 | 1.3 | 1.3 | 1.3 |
| nmax/nmin | | 1.3 | 1.3 | 1.3 | 1.2 | 1.2 | 1.2 | 1.3 |
| Wall face curvature Ratio % (1/2/3/4) | | 90/84/79/73 | 90/88/86/77 | 90/88/86/82 | 90/89/89/88 | 89/88/88/87 | 90/88/88/85 | 90/88/86/82 |
| Total dimples volume ($mm^3$) | | 335 | 341 | 347 | 344 | 350 | 340 | 345 |
| Head speed 45 m/sec | | | | | | | | |
| Carry (m) | | 215 | 214 | 214 | 215 | 212 | 210 | 210 |
| Run (m) | | 15 | 18 | 20 | 21 | 20 | 21 | 22 |
| Total (m) | | 230 | 232 | 234 | 236 | 232 | 231 | 232 |
| Trajectory height* (index) | | 6.5 | 6.4 | 6.4 | 6.3 | 6.2 | 6.1 | 6.0 |
| Time staying in air (sec) | | 5.67 | 5.62 | 5.56 | 5.57 | 5.53 | 5.51 | 5.45 |

*Trajectory height is in index, and actual height (m) is obtained when it is multiplied by a constant.

Hereinbelow, details of the embodiments 1 through 7 referred to in Table 1 will be given.

Embodiments 1 through 7

Large size two piece balls are employed, with the constructions thereof following the embodiment 1 of Japanese Laid-Open Patent Application Tokkaisho No. 59-57675. Data for the items given in Table 1 are as follows.

Embodiment 1: Dimple arranging pattern of FIG. 1.
Embodiment 2: Dimple arranging pattern of FIG. 2.
Embodiment 3: Dimple arranging pattern of FIG. 3.
Embodiment 4: Dimple arranging pattern of FIG. 4.
Embodiment 5: Dimple arranging pattern of FIG. 5.
Embodiment 6: Dimple arranging pattern of FIG. 6.
Embodiment 7: Dimple arranging pattern of FIG. 7.

It is to be noted that each of the embodiments 1 to 4, and 6 and 7 has one great circle zone, with the exception of the embodiment 5 which has six great circle zones. Meanwhile, the "frontage depth" given in the parenthesis under the dimple depth in Table 1 represents the height from the lowest portion 9 of the dimple to the dimple edge 6. Moreover, the wall face curvature ratio is a value (Ra/Ro)×100% showing the dimple spherical surface radius Ro and the wall face 10 in the range A between one point descended by 30 microns and another point descended by 90 microns from the dimple edge 6 in the direction of depth, by the ratio of the apparent spherical radius Ra obtained by the method of least squares as converted to a right sphere having a center on a straight line connecting the dimple center and ball center, and the dimple inclination angle becomes more acute as the above value becomes smaller. It is to be noted that each of the embodiments 1 to 7 relates to the golf ball of polyhedric division, with the dodecahedron arranging patterns.

Subsequently, Table 2 below shows the kinds of balls employed for the comparative examples 1 to 3, and the results of experiments in the form of a list.

TABLE 2

Figure 8:
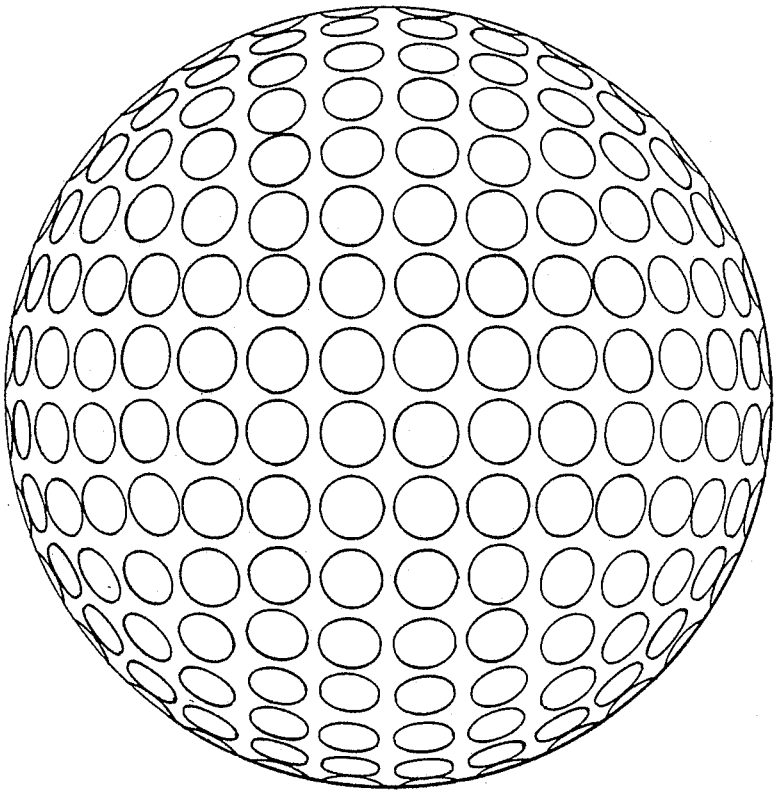
FIGS. 8, 9 and 10 are views similar to FIGS. 1 through 7, which particularly show dimple arranging patterns for comparative examples.
Figure 9:
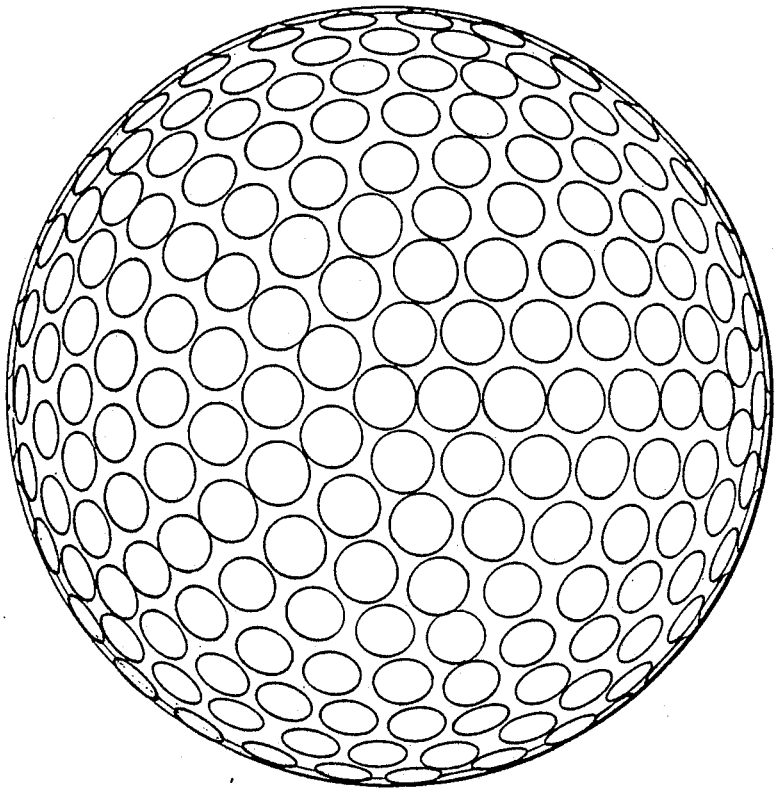
Figure 10:
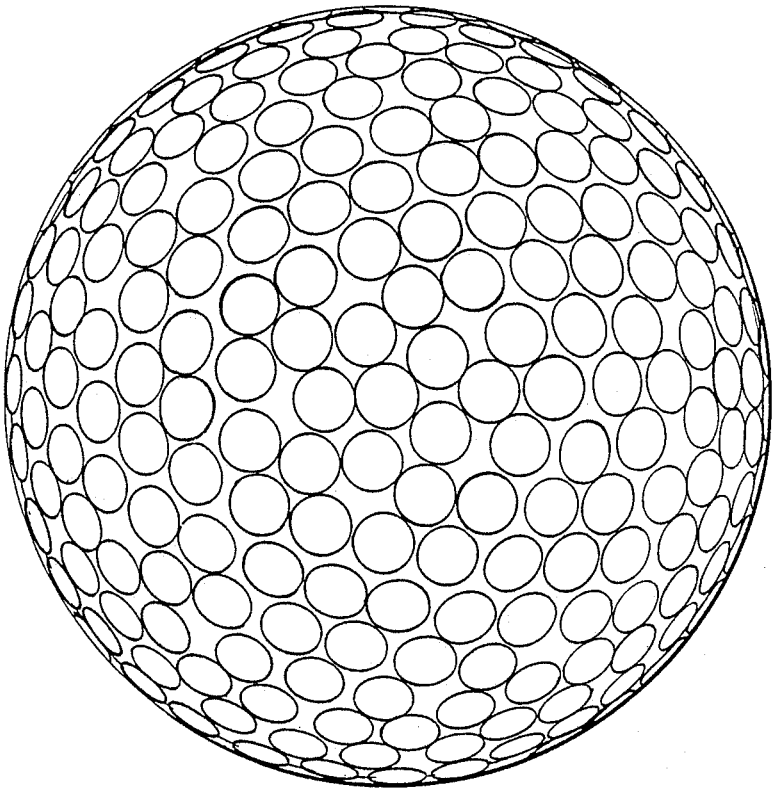

| | | Compar. 1 | Compar. 2 | Compar. 3 |
|---|---|---|---|---|
| Corresponding figure | | FIG. 8 | FIG. 9 | FIG. 10 |
| Total No. of dimples | | 336 | 392 | 432 |
| Dimple | | | | |
| Dia.-Depth-No. | No. 1 | 3.6-0.33-336 | 3.6-0.26-392 | 3.6-0.25-432 |
| (mm) (mm) | large | (0.25) | (0.18) | (0.17) |
| (Frontage | No. 2 | — | — | — |

TABLE 2-continued

| | | Compar. 1 | Compar. 2 | Compar. 3 |
|---|---|---|---|---|
| Corresponding figure | | FIG. 8 | FIG. 9 | FIG. 10 |
| Total No. of dimples | | 336 | 392 | 432 |
| depth) | large | | | |
| | No. 3 | — | — | — |
| | large | | | |
| | No. 4 | — | — | — |
| | large | | | |
| Cmax/Cmin | | 1.0 | 1.0 | 1.0 |
| Emax/Emin | | 1.0 | 1.0 | 1.0 |
| nmax/nmin | | 1.0 | 1.0 | 1.0 |
| Wall face Curvature ratio % (1/2/3/4) | | 100 | 100 | 100 |
| Total dimples volume ($mm^3$) | | 370 | 360 | 367 |
| Head speed 45 m/sec | | | | |
| Carry (m) | | 206 | 208 | 206 |
| Run (m) | | 15 | 19 | 20 |
| Total (m) | | 221 | 227 | 226 |
| Trajectory height* (index) | | 6.4 | 5.7 | 5.8 |
| Time staying in air (sec) | | 5.66 | 5.40 | 5.26 |

*Trajectory height is in index, and actual height (m) is obtained when it is multiplied by a constant.

Comparative example 1

The golf ball with 336 dimples in the conventional octahedric arranging pattern as shown in FIG. 8 has the construction similar to that of the embodiments 1 to 7, with data as shown in Table 2.

Comparative example 2

The golf ball with 392 dimples in the icosahedric arranging pattern as disclosed in the example of Japanese Patent Publication Tokkosho No. 58-50744, and shown in FIG. 9, has the construction similar to that of the embodiments 1 to 7, with data as given in Table 2.

Comparative example 3

The golf ball with 432 dimples in the icosahedric arranging pattern as disclosed in Japanese Laid-Open Patent Application Tokkaisho No. 60-234674, and shown in FIG. 10, has the construction similar to that of the embodiments 1 to 7, with data as shown in Table 2.

Upon comparison of the golf balls of the embodiments 1 through 7 with those of the above comparative examples 1 to 3, the golf balls of the embodiments 1 to 7 are superior to the latter by 2 to 9 m in the flight carry and by 3 to 15 m in the total distance, and thus, the effect of the present invention for the increase of the flying distance has been ensured.

As described so far, by the combination of a plurality of dimples different in the configurations (particularly, by the combination of four kinds of dimples ranging from the large and deep dimples to the small and shallow dimples), flight performance not obtainable in the prior art has been realized.

It is to be noted here that the concept of the present invention is not limited in its application to the two piece golf balls as in the foregoing embodiments alone, but may be readily applied to thread wound golf balls, and multi-layered or single layered solid balls, etc. and also to small sized golf balls. Furthermore, in the foregoing embodiments, although the dodecahedric arrangement is described as the fundamental pattern, the present invention is also applied to the octahedric and icosahedric arrangements as well.

According to the golf ball of the present invention, different from the state where dimples are regularly aligned in order, air stream is more disturbed in any of the rotating axes on the spherical surface of the golf ball, with the separating point retreating backwards, while in the respective speed region during the flight of the golf ball, dimples of respective dimple configurations act effectively. In other words, in the high speed region, dimples having a small dimple effect display their effect, and in the low speed region, dimples having a large dimple effect display the effect thereof. Consequently, the lift and drag for the golf ball from the high speed region to the low speed region during the flight of the golf ball are optimized, thus providing the effect for increasing the flight distance. With respect to the trajectory shape, the undesirable "hop" which may take place in the golf balls having conventional dimples when it is intended to increase the flight carry, is not produced, and the golf ball of the present invention is allowed to readily fly straight, extending over a sufficient distance, without being affected by wind.

Moreover, in the prior art golf balls having dimples of one kind, the number of dimples is normally in the range of 330 to 390, and when this number of dimples is designed to be smaller, the flying distance tends to be decreased due to the rising, etc. at the latter half of the flight. When the number of dimples is designed to be larger, the flying distance is similarly decreased by the increase of drag and the reduction of lift at the first half of the flight. However, in the golf ball according to the present invention, even when the number of dimples is reduced, there is no reduction in the flight distance resulting from an increase of drag by the increase of a rear flow region to be brought about by an advance of the lower separating point, which takes place at the low speed region in a golf balls having a single kind of dimples. On the other hand, even if the number of dimples is increased, the reduction in the flight distance as referred to above does not take place, either, and thus, a stable flying distance may be obtained. According to the present invention, it is preferable to set the upper limit for the number of dimples at 560, and the lower limit thereof at 240.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A golf ball comprising:

a main body having a spherical surface;

a plurality of different kinds of dimples formed on said spherical surface of said main body, wherein a difference between said different kinds of dimples is adapted to be a difference in diameter, in depth, or in a combination of diameter and depth, and the ratio of the product of the diameter and the depth of the largest dimple, to the product of the diameter and depth of the smallest dimple, is in the range of 1.5 to 2.0; and smooth portions formed on the remainder of said spherical surface, each of said smooth portions being formed to such a size that a dimple having an area larger than an average area calculated from the respective areas of each kind of dimple constituting said plurality of different kinds of dimples cannot be formed, wherein the total number of dimples is between 300 to 560, and there is a maximum of one great circle zone not traversing a part of any dimple.

2. The golf ball as claimed in claim 1, wherein said plurality of different kinds of dimples include four different kinds of dimples.

3. The golf ball according to claim 2, wherein, in the plurality of different kinds of dimples, the number of dimples of the kind which is smallest in size is above 10% of the total number of dimples.

4. The golf ball according to claim 2, wherein an apparent radius of a dimple spherical face in a range between one point descended from an edge of said dimple by 30 microns and another point descended therefrom by 90 microns in a direction of depth of the dimple, is adapted to be 70 to 90% of the radius of the dimple spherical face derived from the diameter and depth of said dimple wherein the diameter of said dimple means the distance between the edges of said dimple, and the depth is the distance from an imaginary spherical surface of the golf ball to the lowest point of the dimple.

5. The golf ball as claimed in claim 1, wherein an apparent radius of a dimple spherical face in a range between one point descended from an edge of said dimple by 30 microns and another point descended therefrom by 90 microns in a direction of depth of the dimple, is adapted to be 70 to 90% of the radius of the dimple spherical face derived from the diameter and depth of said dimple wherein the diameter of said dimple means the distance between the edges of said dimple, and the depth is the distance from an imaginary spherical surface of the golf ball to the lowest point of the dimple.

6. The golf ball according to claim 1, wherein one great circle zone does not traverse a part of any dimple.

7. The golf ball according to claim 1, wherein, in the plurality of different kinds of dimples, the number of dimples of the kind which is smallest in size is above 10% of the total number of dimples.

8. The golf ball according to claim 7, wherein the depth of each dimple is increased as the diameter thereof is increased, and the ratio of the product of the diameter and the depth of the largest dimple, to the product of the diameter and depth of the smallest dimple, is in the range of 1.5 to 2.0.

9. The golf ball according to claim 7, wherein the depth of each dimple is increased as the diameter thereof is increased, and the ratio of the product of the diameter and the depth of the largest dimple, to the product of the diameter and depth of the smallest dimple, is in the range of 1.5 to 2.0.

10. The golf ball according to claim 7, wherein an apparent radius of a dimple spherical face in a range between one point descended from an edge of said dimple by 30 microns and another point descended therefrom by 90 microns in a direction of depth of the dimple, is adapted to be 70 to 90% of the radius of the dimple spherical face derived from the diameter and depth of said dimple wherein the diameter of said dimple means the distance between the edges of said dimple, and the depth thereof is the distance from an imaginary spherical surface of the golf ball to the lowest point of the dimple.

11. The golf ball according to claim 1, wherein said smooth portions are the areas surrounded by any four dimples.

12. The golf ball according to claim 1, wherein the cumulative area of said dimples ranges from 250 to 400 $mm^3$.

13. The golf ball as claimed in claim 1, wherein the maximum and minimum values of ratios of dimple diameters, and the maximum and minimum values of ratios of dimple depths, are both in the range of 1.2–1.5.

14. A golf ball comprising:

a main body having a spherical surface, a plurality of four different kinds of dimples formed on a spherical surface of said main body; and smooth portions formed on the remainder of said spherical surface, each of said smooth portions being formed to such a size that a dimple having an area larger than an average area calculated from the respective areas of each kind of dimple constituting said plurality of four different kinds of dimples cannot be formed; wherein a total number of dimples is between 300 to 500, and there is a maximum of one great circle zone not traversing a part of any dimple.

15. The golf ball according to claim 14, wherein, in the plurality of different kinds of dimples, the number of dimples of the kind which is smallest in size is above 10% of the total number of dimples.

16. The golf ball according to claim 14, wherein a difference between said different kinds of dimples is adapted to be a difference in diameter, in depth or in a combination of diameter and depth, and the ratio of the product of the diameter and the depth of the largest dimple, to the product of the diameter and depth of the smallest dimple, is in the range of 1.5 to 2.0.

17. The golf ball according to claim 14, wherein an apparent radius of a dimple spherical face in a range between one point descended from an edge of said dimple by 30 microns and another point descended therefrom by 90 microns in a direction of depth of the dimple, is adapted to be 70 to 90% of the radius of the dimple spherical face derived from the diameter and depth of said dimple wherein the diameter of said dimple means the distance between the edges of said dimple, and the depth thereof is the distance from an imaginary spherical surface of the golf ball to the lowest point of the dimple.

18. The golf ball according to claim 17, wherein an apparent radius of a dimple spherical face in a range between one point descended from an edge of said dimple by 30 microns and another point descended therefrom by 90 microns in a direction of depth of the dimple, is adapted to be 70 to 90% of the radius of the dimple spherical face derived from the diameter and depth of said dimple wherein the diameter of said dimple means the distance between the edges of said dimple, and the depth thereof is the distance from an imaginary spherical surface of the golf ball to the lowest point of the dimple.

19. The golf ball as claimed in claim 14, wherein the maximum and minimum values of ratios of dimple diameters, and the maximum and minimum values of ratios of dimple depths, are both in the range of 1.2–1.5.

* * * * *